US008297082B2

(12) United States Patent
Son et al.

(10) Patent No.: US 8,297,082 B2
(45) Date of Patent: Oct. 30, 2012

(54) LAUNDRY MACHINE

(75) Inventors: Young Bok Son, Gyeongsangnam-do (KR); Dong Joo Han, Gyeongsangnam-do (KR); Jong Chul Bang, Gyeongsangnam-do (KR); Ki Chul Cho, Gyeongsangnam-do (KR); Jae Yoen Lim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 510 days.

(21) Appl. No.: 12/432,432

(22) Filed: Apr. 29, 2009

(65) Prior Publication Data

US 2010/0077801 A1 Apr. 1, 2010

(30) Foreign Application Priority Data

Apr. 30, 2008 (KR) ..... 10-2008-0040600
Apr. 30, 2008 (KR) ..... 10-2008-0040609

(51) Int. Cl.
*D06F 29/00* (2006.01)

(52) U.S. Cl. ..... 68/20; 68/3 R

(58) Field of Classification Search ..... None
See application file for complete search history.

(56) References Cited

U.S. PATENT DOCUMENTS

| | | | |
|---|---|---|---|
| 2,165,487 | A | 7/1939 | Johnson |
| 2,351,429 | A | 9/1942 | Huebsch |
| 2,369,366 | A | 2/1945 | O'Neill |
| 2,566,488 | A | 4/1945 | Gould |
| 2,486,058 | A | 10/1949 | Patterson et al. |
| 2,543,579 | A | 2/1951 | Kauffmann, II |
| 2,547,238 | A | 4/1951 | Tremblay |
| 2,611,192 | A | 9/1952 | Huebsch |
| 2,687,578 | A | 8/1954 | Richterkessing |
| 2,707,837 | A | 5/1955 | Robinson et al. |
| 2,716,820 | A | 9/1955 | Bourner |
| 2,722,057 | A | 11/1955 | Pugh |
| 2,727,315 | A | 12/1955 | Candor |
| 2,728,481 | A | 12/1955 | Robinson et al. |
| 2,742,708 | A | 4/1956 | McCormick |
| 2,752,004 | A | 6/1956 | Hullar |
| 2,795,055 | A | 6/1957 | Huebsch |
| 2,813,353 | A | 11/1957 | McMillan |
| 2,816,429 | A | 12/1957 | Kurlancheek |
| 2,817,157 | A | 12/1957 | McCormick |

(Continued)

FOREIGN PATENT DOCUMENTS

CN 2157212 Y 2/1994

(Continued)

OTHER PUBLICATIONS

Korean Patent Office machine translation of KR 1020050115969 to Lee, retrieved from http://kposd.kipo.go.kr:8088/up/kpion/ on Oct. 19, 2011.*

*Primary Examiner* — Michael Kornakov
*Assistant Examiner* — Eric Golightly
(74) *Attorney, Agent, or Firm* — Birch, Stewart, Kolasch & Birch, LLP

(57) ABSTRACT

A laundry machine includes a first laundry treatment space configured to receive laundry therein, a second laundry treatment space configured to receive laundry therein and an air supply unit configured to supply air to the second laundry treatment space, the air supply unit comprising a fan, a heater and a housing, and wherein the housing accommodates the fan, the heater, an inlet and an outlet.

7 Claims, 17 Drawing Sheets

U.S. PATENT DOCUMENTS

| | | | |
|---|---|---|---|
| 2,817,501 | A | 12/1957 | Schubert |
| 2,843,945 | A | 7/1958 | Whyte |
| 2,861,355 | A | 11/1958 | Douglas |
| 2,867,430 | A | 1/1959 | Hullar |
| 2,903,799 | A | 9/1959 | Sachaczenski |
| 2,904,895 | A | 9/1959 | Bochan |
| 2,985,967 | A | 5/1961 | Pataillot et al. |
| 3,000,108 | A | 9/1961 | Jones et al. |
| 3,001,295 | A | 9/1961 | Miller |
| 3,023,514 | A | 3/1962 | Gibson |
| 3,061,942 | A | 11/1962 | Scofield |
| 3,064,358 | A | 11/1962 | Giuffre |
| 3,121,000 | A | 2/1964 | Hubbard |
| 3,383,776 | A | 5/1968 | Wilhoyte |
| 3,402,477 | A | 9/1968 | Hubbard |
| 3,555,701 | A | 1/1971 | Hubbard |
| 3,579,851 | A | 5/1971 | Elmy |
| 3,789,514 | A | 2/1974 | Faust et al. |
| 3,840,998 | A | 10/1974 | Marcussen |
| 4,557,058 | A | 12/1985 | Ozawa et al. |
| 4,653,200 | A | 3/1987 | Werner |
| 5,062,219 | A | 11/1991 | Harris et al. |
| 5,136,792 | A | 8/1992 | Janecke |
| 5,165,181 | A | 11/1992 | Acosta, Sr. et al. |
| 5,279,047 | A | 1/1994 | Janecke |
| 5,443,538 | A | 8/1995 | Little |
| 5,560,120 | A | 10/1996 | Swanson et al. |
| 5,664,339 | A | 9/1997 | Swanson et al. |
| 5,784,901 | A | 7/1998 | Yanase et al. |
| 6,016,610 | A | 1/2000 | Sears |
| 6,094,839 | A | 8/2000 | Nikolov |
| 6,151,795 | A | 11/2000 | Hoffman et al. |
| 6,374,644 | B1 | 4/2002 | Rhode et al. |
| 6,618,887 | B2 | 9/2003 | Kim et al. |
| 6,671,978 | B1 | 1/2004 | McGowan et al. |
| 6,732,553 | B2 | 5/2004 | Rhode et al. |
| 6,978,556 | B1 | 12/2005 | Cornelious |
| 7,036,243 | B2 | 5/2006 | Doh et al. |
| 7,055,262 | B2 | 6/2006 | Goldberg et al. |
| 7,065,904 | B2 | 6/2006 | Lee et al. |
| 7,251,905 | B2 | 8/2007 | Doh et al. |
| 7,281,775 | B2 | 10/2007 | Yang |
| 7,404,303 | B1 | 7/2008 | Barbosa et al. |
| 7,497,030 | B2 | 3/2009 | Belgard |
| 7,520,145 | B2 | 4/2009 | Hong et al. |
| 7,591,082 | B2 | 9/2009 | Lee et al. |
| 7,624,601 | B2 | 12/2009 | Ikemizu et al. |
| 7,644,515 | B2 | 1/2010 | Doh |
| 7,665,225 | B2 | 2/2010 | Goldberg et al. |
| 7,665,227 | B2 | 2/2010 | Wright et al. |
| 7,673,358 | B2 | 3/2010 | Dietz et al. |
| 7,707,858 | B2 | 5/2010 | Jeon et al. |
| 7,707,860 | B2 | 5/2010 | Hong et al. |
| 7,735,345 | B2 | 6/2010 | Wright et al. |
| 7,748,139 | B2 | 7/2010 | Hong et al. |
| 7,836,607 | B2 | 11/2010 | Kim |
| 7,849,717 | B2 | 12/2010 | Sunshine |
| 7,895,770 | B2 | 3/2011 | Bae et al. |
| 7,913,419 | B2 | 3/2011 | Tomasi et al. |
| 7,921,578 | B2 | 4/2011 | McAllister et al. |
| 7,921,679 | B2 | 4/2011 | Jo |
| 2002/0017117 | A1 | 2/2002 | Sunshine et al. |
| 2002/0092329 | A1 | 7/2002 | Rhode et al. |
| 2002/0154011 | A1 | 10/2002 | Pasin et al. |
| 2003/0079368 | A1 | 5/2003 | Hoffman |
| 2004/0134237 | A1 | 7/2004 | Sunshine et al. |
| 2005/0066538 | A1 | 3/2005 | Goldberg et al. |
| 2005/0066999 | A1 | 3/2005 | Dietz et al. |
| 2005/0120585 | A1 | 6/2005 | Lee et al. |
| 2005/0126035 | A1 | 6/2005 | Lee et al. |
| 2005/0132593 | A1 | 6/2005 | Doh et al. |
| 2005/0132594 | A1 | 6/2005 | Doh et al. |
| 2005/0132604 | A1 | 6/2005 | Hong et al. |
| 2006/0075790 | A1 | 4/2006 | Jeon et al. |
| 2006/0112585 | A1 | 6/2006 | Choi et al. |
| 2006/0123853 | A1 | 6/2006 | Hong et al. |
| 2006/0156765 | A1 | 7/2006 | Sunshine et al. |
| 2006/0179676 | A1 | 8/2006 | Goldberg et al. |
| 2006/0186222 | A1 | 8/2006 | Ikemizu et al. |
| 2006/0289533 | A1 | 12/2006 | Park et al. |
| 2007/0062513 | A1 | 3/2007 | Gagas |
| 2007/0068034 | A1 | 3/2007 | Kim |
| 2007/0113419 | A1 | 5/2007 | Belgard |
| 2007/0119072 | A1 | 5/2007 | Kim |
| 2007/0144031 | A1 | 6/2007 | Lee |
| 2007/0151041 | A1 | 7/2007 | McAllister et al. |
| 2007/0151120 | A1 | 7/2007 | Tomasi et al. |
| 2007/0151129 | A1 | 7/2007 | McAllister et al. |
| 2007/0151301 | A1 | 7/2007 | Kendall et al. |
| 2007/0151310 | A1 | 7/2007 | Wright et al. |
| 2007/0151311 | A1 | 7/2007 | McAllister et al. |
| 2007/0151312 | A1 | 7/2007 | Bruce et al. |
| 2007/0163093 | A1 | 7/2007 | Wright et al. |
| 2007/0163094 | A1 | 7/2007 | Wright et al. |
| 2007/0163095 | A1 | 7/2007 | McAllister et al. |
| 2007/0163096 | A1 | 7/2007 | McAllister et al. |
| 2007/0163097 | A1 | 7/2007 | Metcalfe et al. |
| 2007/0163098 | A1 | 7/2007 | Tomasi et al. |
| 2007/0249212 | A1 | 10/2007 | Buecker et al. |
| 2008/0006224 | A1 | 1/2008 | Ahn et al. |
| 2008/0052950 | A1 | 3/2008 | Park et al. |
| 2008/0053162 | A1 | 3/2008 | Park et al. |
| 2008/0053163 | A1 | 3/2008 | Park et al. |
| 2008/0053164 | A1 | 3/2008 | Park et al. |
| 2008/0053166 | A1 | 3/2008 | Lim |
| 2008/0141550 | A1 | 6/2008 | Bae et al. |
| 2008/0141552 | A1 | 6/2008 | Bae et al. |
| 2008/0141554 | A1 | 6/2008 | Bae et al. |
| 2008/0141557 | A1 | 6/2008 | Son et al. |
| 2008/0141558 | A1 | 6/2008 | Bae et al. |
| 2008/0141734 | A1 | 6/2008 | Son et al. |
| 2008/0148494 | A1 | 6/2008 | Son et al. |
| 2008/0163651 | A1 | 7/2008 | Jeong et al. |
| 2008/0168679 | A1 | 7/2008 | Son et al. |
| 2008/0252189 | A1 | 10/2008 | Regan |
| 2008/0256989 | A1 | 10/2008 | Jeong et al. |
| 2008/0271263 | A1 | 11/2008 | Bae et al. |
| 2008/0271336 | A1 | 11/2008 | Doh |
| 2008/0271500 | A1 | 11/2008 | Ahn |
| 2008/0276659 | A1 | 11/2008 | Bae et al. |
| 2008/0276660 | A1 | 11/2008 | Bae et al. |
| 2008/0276661 | A1 | 11/2008 | Bae et al. |
| 2008/0282745 | A1 | 11/2008 | Han et al. |
| 2009/0057527 | A1 | 3/2009 | Jo |
| 2009/0113745 | A1 | 5/2009 | Choi et al. |
| 2009/0113755 | A1 | 5/2009 | Choi et al. |
| 2009/0126222 | A1 | 5/2009 | Bae et al. |
| 2009/0126421 | A1 | 5/2009 | Kim et al. |
| 2009/0133281 | A1 | 5/2009 | Yoon et al. |
| 2009/0133284 | A1 | 5/2009 | Belgard |
| 2009/0158616 | A1 | 6/2009 | Ricklefs et al. |
| 2009/0193856 | A1 | 8/2009 | Park et al. |
| 2009/0235551 | A1 | 9/2009 | Jo et al. |
| 2009/0241606 | A1 | 10/2009 | Yoo et al. |
| 2009/0260246 | A1 | 10/2009 | Bae et al. |
| 2009/0265953 | A1 | 10/2009 | Bae et al. |
| 2009/0277036 | A1 | 11/2009 | Lee et al. |
| 2009/0277037 | A1 | 11/2009 | Lim |
| 2009/0288456 | A1 | 11/2009 | Bae et al. |
| 2009/0320313 | A1 | 12/2009 | Bae et al. |
| 2010/0000112 | A1 | 1/2010 | Carow et al. |
| 2010/0000114 | A1 | 1/2010 | Dalton et al. |
| 2010/0000117 | A1 | 1/2010 | Choi et al. |
| 2010/0005681 | A1 | 1/2010 | Jo et al. |
| 2010/0011609 | A1 | 1/2010 | Park et al. |
| 2010/0018262 | A1 | 1/2010 | Beihoff et al. |
| 2010/0024243 | A1 | 2/2010 | Ricklefs et al. |
| 2010/0077801 | A1 | 4/2010 | Son et al. |
| 2010/0083521 | A1 | 4/2010 | Han et al. |
| 2010/0083708 | A1 | 4/2010 | Han et al. |
| 2010/0083709 | A1 | 4/2010 | Han et al. |
| 2010/0083710 | A1 | 4/2010 | Han et al. |
| 2010/0083711 | A1 | 4/2010 | Han et al. |
| 2010/0115784 | A1 | 5/2010 | Jo et al. |
| 2010/0146812 | A1 | 6/2010 | Ahn et al. |
| 2010/0182136 | A1 | 7/2010 | Pryor |
| 2010/0186176 | A1 | 7/2010 | Wright et al. |

| | | | | |
|---|---|---|---|---|
| 2010/0192397 | A1 | 8/2010 | Kim et al. | |
| 2010/0206016 | A1 | 8/2010 | Bae et al. | |
| 2010/0231506 | A1 | 9/2010 | Pryor | |
| 2010/0281929 | A1* | 11/2010 | Han et al. | 68/5 C |
| 2010/0327766 | A1 | 12/2010 | Recker et al. | |
| 2011/0005276 | A1 | 1/2011 | Moon et al. | |
| 2011/0016928 | A1 | 1/2011 | Beihoff et al. | |
| 2011/0030147 | A1 | 2/2011 | Yoo et al. | |
| 2011/0030428 | A1* | 2/2011 | Han et al. | 68/5 R |
| 2011/0047814 | A1 | 3/2011 | Watson et al. | |
| 2011/0067457 | A1* | 3/2011 | Han et al. | 68/13 R |
| 2011/0083338 | A1 | 4/2011 | Carow et al. | |

FOREIGN PATENT DOCUMENTS

| | | | |
|---|---|---|---|
| CN | 1349012 | A | 5/2002 |
| CN | 101153455 | A | 4/2008 |
| CN | 101153456 | A | 10/2008 |
| DE | 203 02 572-US | | 4/2003 |
| EP | 0627519 | A1 | 12/1994 |
| EP | 0 666 355 | A1 | 8/1995 |
| EP | 1353004 | A1 | 10/2003 |
| EP | 1524356 | A1 | 4/2005 |
| EP | 1726703 | A1 | 11/2006 |
| FR | 1 473 011 | | 2/1967 |
| GB | 1510528 | A | 5/1978 |
| GB | 1 545 078 | | 5/1979 |
| JP | 54-108060 | A | 8/1979 |
| JP | 60-238693 | A | 11/1985 |
| JP | 60-238695 | A | 11/1985 |
| JP | 1-266000 | A | 10/1989 |
| JP | 2-128797 | A | 5/1990 |
| JP | 3-126490 | A | 5/1991 |
| JP | 3-289999 | A | 12/1991 |
| JP | 4-126195 | A | 4/1992 |
| JP | 04-187194 | A1 | 7/1992 |
| JP | 4-338495 | A | 11/1992 |
| JP | 4-367697 | A | 12/1992 |
| JP | 5-49795 | A | 3/1993 |
| JP | 5-49796 | A | 3/1993 |
| JP | 6-293 | A | 1/1994 |
| JP | 6-134187 | A | 5/1994 |
| JP | 6-254296 | A | 9/1994 |
| JP | 6-277396 | A | 10/1994 |
| JP | 6-190193 | A | 12/1994 |
| JP | 07-148394 | A | 6/1995 |
| JP | 8-155194 | A | 6/1996 |
| JP | 8-196798 | A | 8/1996 |
| JP | 8-229298 | A | 9/1996 |
| KR | 2001-0088209 | A | 9/2001 |
| KR | 10-2003-0016860 | A | 3/2003 |
| KR | 10-2005-0115968 | A | 12/2005 |
| KR | 1020050115969 | * | 12/2005 |
| RU | 2291922 | C2 | 1/2007 |
| RU | 2317357 | C2 | 2/2008 |
| SU | 1687682 | A1 | 10/1991 |
| WO | WO 2008/013411 | A2 | 1/2008 |
| WO | WO 2008/013413 | A2 | 1/2008 |
| WO | WO 2008/023910 | A2 | 2/2008 |
| WO | WO 2008/123699 | A2 | 10/2008 |
| WO | WO 2008/127027 | A2 | 10/2008 |

* cited by examiner

LAUNDRY MACHINE

CROSS REFERENCE TO RELATED APPLICATION

This application claims the benefit of the Korean Patent Application Nos. 10-2008-0040600, filed on Apr. 30, 2008 and 10-2008-0040609, filed on Apr. 30, 2008 which are hereby incorporated by reference as if fully set forth herein.

BACKGROUND OF THE DISCLOSURE

1. Field of the Disclosure

The present invention relates to a laundry machine.

2. Discussion of the Related Art

Generally, laundry machines are home appliances that are used to clean laundry by washing and drying laundry, using detergent and mechanical friction. Laundry machines are categorized into washing machines, dryers and single appliances performing both washing and drying functions.

SUMMARY OF THE DISCLOSURE

The present invention is directed to a laundry machine.

An object of the present invention is to provide a laundry machine with enhanced laundering efficiency, and which has an improved overall exterior appearance.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a cabinet; a partition partitioning inner space of the cabinet into a first space for main washing treatment of laundry and a second space for auxiliary washing treatment of laundry; a air supply unit provided in a bottom surface of the first space, the air supply unit selectively heating air inside the cabinet and supplying air downward to the second space, wherein the air supply unit comprises a single housing, a fan and a heating part, the fan and the heating part provided in the housing.

The air supply unit may include a water preventing part preventing water from penetrating into the housing.

The housing may include a lower housing detachably provided in the cabinet; and an upper housing detachably coupled to the lower housing. The water preventing part may include a first extending portion extending downward from an edge of the upper housing to cover a predetermined portion of the housing; and a second extending portion extending upward from an edge of the lower housing to be insertedly coupled to the first extending portion.

The housing may further include a through hole communicating inside with outside of the housing for a wire to pass through and the water preventing part may include an inflow preventing part preventing water from inflowing via the through hole.

The air supply unit may include a motor provided underneath the housing, the motor rotating the fan, and a water access preventing part preventing access of water to a portion underneath the housing where the motor is provided.

The water access preventing part may include a supporting portion extending downward from a bottom of the housing, the water access preventing part preventing covering an outer bottom surface of the housing.

The water access preventing part may include an extending portion provided in the housing, the extending portion preventing access of water to a portion underneath the housing where the motor is provided.

An inlet through which air is drawn into the air supply unit may be formed at a bottom surface of the housing.

A seating portion may be formed integrally with a bottom surface of the housing.

At least one securing boss provided in the seating portion may be secured to the control part and the at least one securing boss may determines a position of the control part precisely.

The inner space of the cabinet may be partitioned into the first space and the second space by the single partition. Here, the air supply unit may be secured to the partition, sliding along a top surface of the partition.

The air supply unit may include at least one boss coupled to the partition by a securing member.

A securing portion may be provided in a top surface of the partition and the securing portion may be projected corresponding to the boss.

The boss may be projected toward upward from the partition and the thickness of the boss and the securing portion may be corresponding to the length of a body of the securing member secured to the boss.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
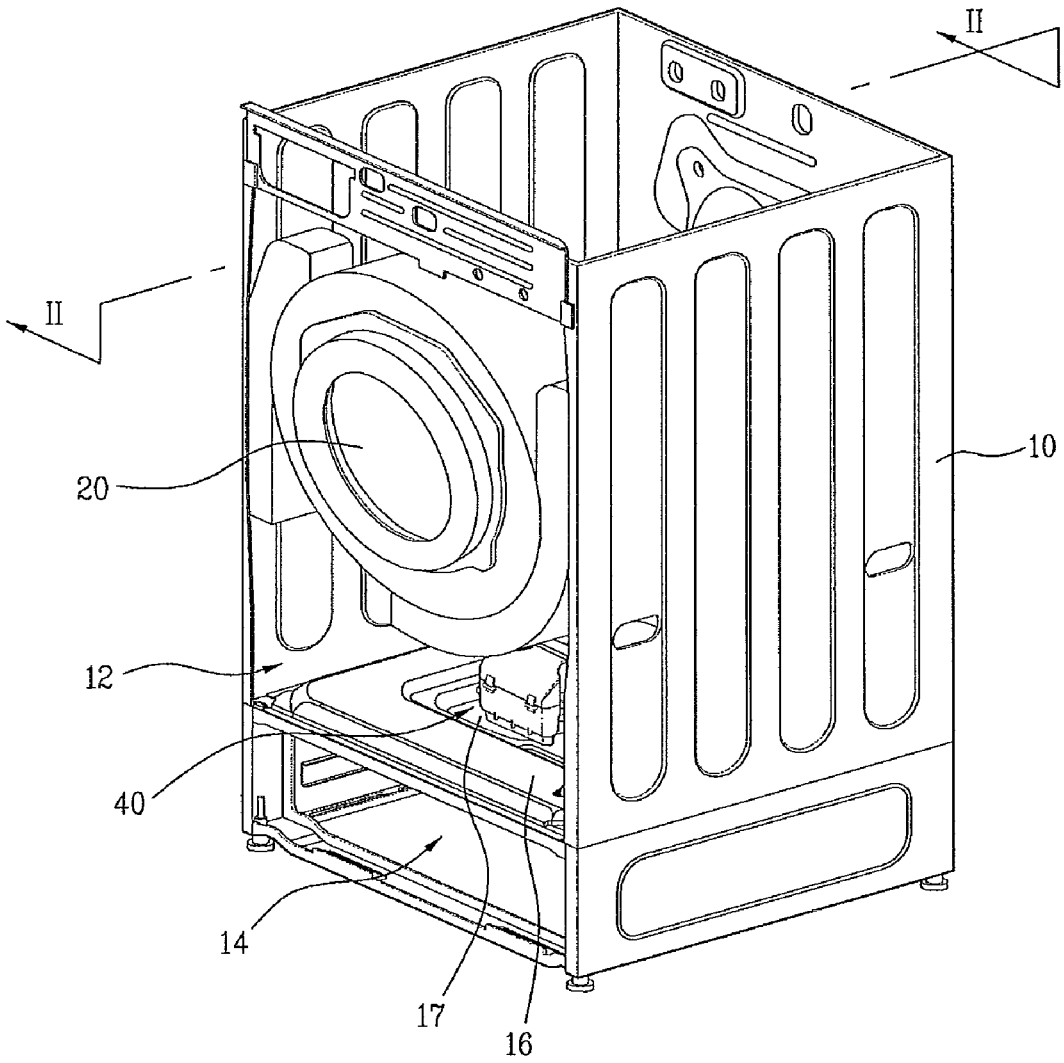
FIG. 1 is a perspective view illustrating a laundry machine according to an exemplary embodiment of the present invention.
Figure 2:
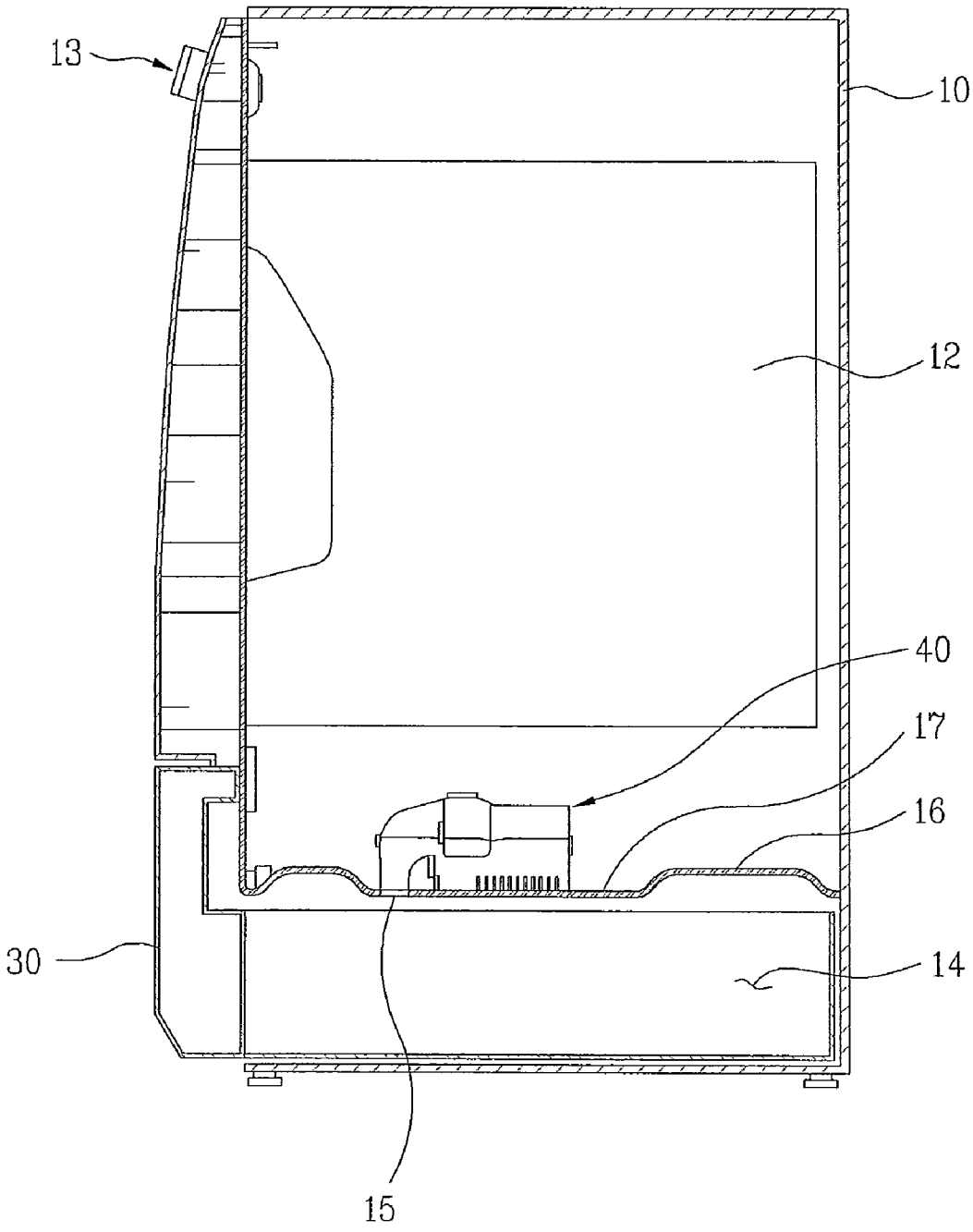
FIG. 2 is a sectional view taken along line shown in FIG. 1.

Referring to FIGS. 1 and 2, a laundry machine includes a cabinet 10 and a partition 16. The partition 16 partitions the inner space into at least two spaces. The partition 16 may be a single partition, which will be described in detail later. The single partition 16 may partition the inner space of the cabinet 10 into a first space or main space 12 and a second space or auxiliary space 14. Main laundry treatment for the laundry may be performed in the first space or main space 12. The first laundry treatment space 12 may include a laundry washing apparatus or a laundry drying apparatus. Auxiliary laundry treatment for the laundry may be performed in the second space or auxiliary space 14. A selector 13 is provided at the cabinet 10 to permit a user to select the desired laundry operations.

Here, the above main laundry treatment may mean conventional washing and/or drying operations, and auxiliary laundry treatment may mean additional drying or refreshing operations for the laundry, or may mean drying or refreshing operations for small-sized laundry. The term 'refreshing' may mean a process of removing wrinkles, deodorizing, sanitizing, preventing static electricity, warming the laundry by supplying air, heated air, or steam, mist or water to the laundry. The term 'laundry' may include not only clothes but also all kinds of wearable objects and apparel such as shoes, socks, gloves and hats. Thus, laundry means all kinds of laundry to which laundering operations can be performed.

The cabinet 10 defines an exterior appearance of the laundry machine. Various components may be mounted in the cabinet 10. A rotatable drum 20 may be provided in the first space 12 inside the cabinet 10, and a detachable drawer 30 may be provided in the second space 14. The drum 20 and the drawer 30 are each configured to receive laundry therein. If the laundry machine is configured as a washing machine or a single appliance having both washing and drying functions, a tub (not shown) for accommodating wash water may be further provided, and the drum 20 may be provided within the tub.

Figure 17:
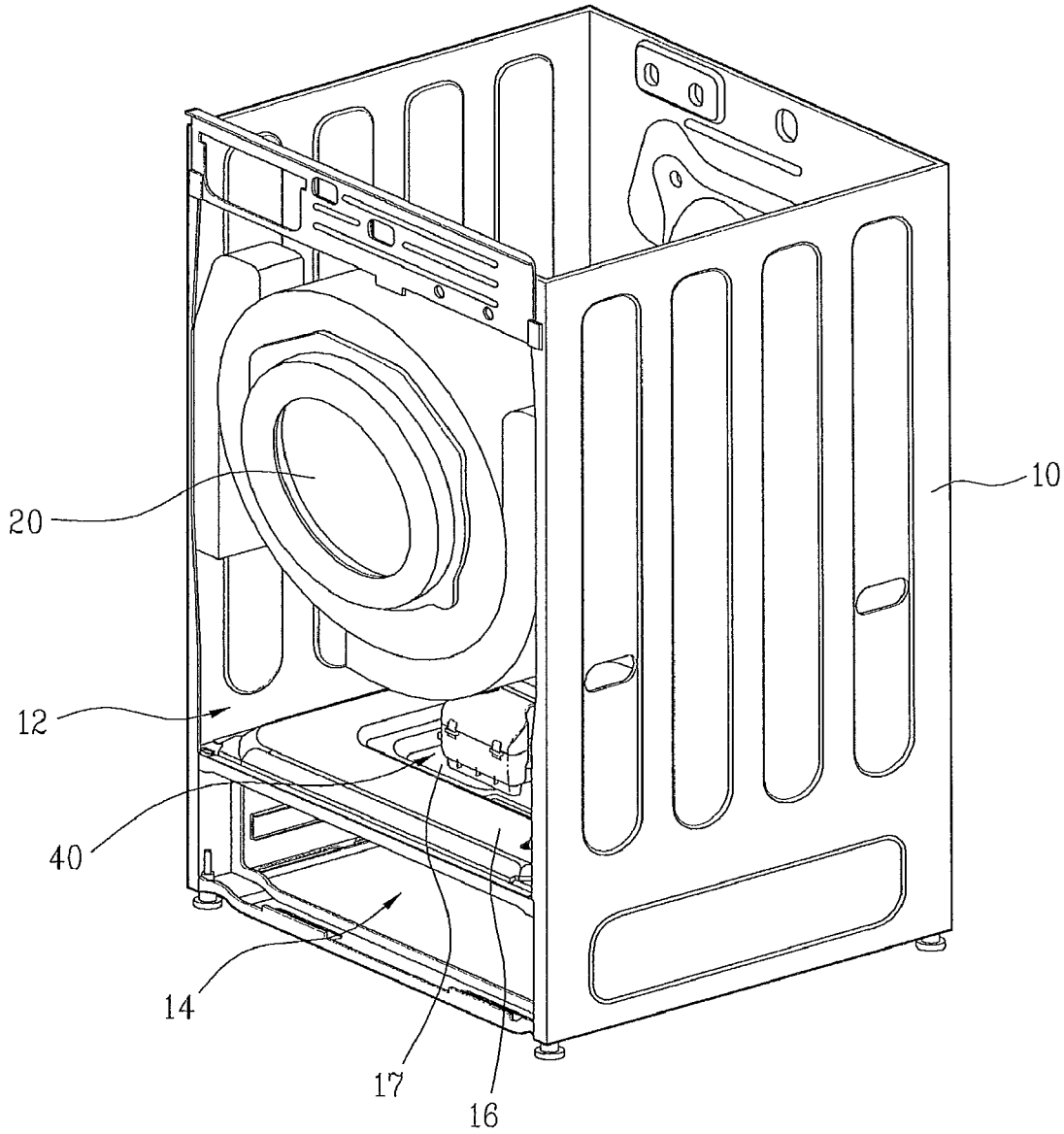
FIG. 17 is a perspective view illustrating a laundry machine according to an exemplary embodiment of the present invention.

The cabinet 10 may be formed of two separate members to include the first space 12 and second space 14. More particularly, the cabinet 10 may included a pair of first sidewalls at opposing sides of the first laundry treatment space 12, and a pair of second sidewalls at opposing sides of the second laundry treatment space 14, the pair of first sidewalls being contiguous with the pair of second sidewalls. Alternatively, the cabinet 10 may be formed of a single member. In one embodiment, the first space 12 and the second space 14 are formed within the cabinet 10 formed of a single member. More particularly, the cabinet 10 may include a first sidewall and a second sidewall, each of the first and second sidewalls extending continuously and uninterrupted from the first laundry treatment space 12 to the second laundry treatment space 14, as shown, for example, in FIG. 17. If the first space 12 and the second space 14 are formed in the cabinet 10 formed of the single member, the assembly work of the cabinet 10 will be simple and the necessary time for assembly will be reduced accordingly.

According to the washing machine of this embodiment, the cabinet 10 formed of a single member includes the first space 12 and the second space 14, and it further includes the partition 16 which partitions the inner space of the cabinet into the first space 12 and the second space 14. The partition 16 may be embodied as a wall located within the cabinet 10 that extends between the first sidewall and the second sidewall. The partition 16 divides the inner space horizontally into an upper space corresponding to the first space 12 and a lower space corresponding to the second space 14. However, the present invention is not limited to the above.

That is, according to this embodiment, the cabinet 10 includes the partition 16 which is simultaneously employed as a base of the first space 12 and as a top cover of the second space 14. More particularly, the partition 16 has a first side and a second side, the first side being exposed to the first laundry treatment space 12, and the second side being exposed to the second laundry treatment space 14. Because the single partition 16 is employed as the base of the first space 12 and the top cover of the second space 14, the assembly work will be remarkably simple and the time necessary for the assembly work will be reduced, compared with a case of including a separate base of the first space and a separate top cover of the second space 14. The provision of a single partition 16, as compared to a separate partition for each of the first and second spaces 12, 14, provides a simple structure for the laundry machine as a whole, and provides a good overall appearance to the laundry machine. In addition, the use of a single partition 16 simplifies assembly, and reduces costs due to the reduction in necessary material as compared with the use of separate partitions. Finally, a single partition 16 permits effective utilization of the first and second spaces 12, 14, and ease of access to the first space 12.

In addition, the laundry machine may further include an air supply unit 40 for supplying air or heated air to the second space 14.

The air supply unit 40 may be provided in the first space 12 and it is envisioned that the air supply unit is provided at a top surface of the partition 16. The partition 16 includes an aperture 15 therein so that air is supplied through the partition 16 and into the second laundry treatment space 14. The air supply unit 40 includes an air outlet 49 (see FIG. 12) that may be directly connected to the aperture 15 in the partition 16. The aperture 15 is located in a central portion of the partition.

The rotatably oriented drum 20 may be provided within the first space 12 and the drawer 30 may be provided within the second space 14. The volume of the first space 12 may be substantially larger than the volume of the second space 14. As a result, to utilize the inner space efficiently, it is envisioned that the air supply unit 40 is provided in the first space 12, rather than in the second space 14. Such an arrangement permits the amount of interior volume of the second space 14 available to receive laundry to be maximized. In addition, providing the air supply unit 40 outside of the second space 14 simplifies the structure of the second space 14 and provides more freedom of design of the second space 14. Finally, because the interior of the second space 14 is readily accessible by a user via the drawer 30, placing the air supply unit 40 in an area other than the second space 14 provides an additional level of safety for the user.

The arrangement of the air supply unit 40 in the first laundry treatment space 12 with the air being supplied through the aperture 15 in the partition 16 provides a mainly downwardly-directed airflow into the second laundry treatment space 14. This downwardly-directed airflow is particularly beneficial for drying or treating shoes 100, because the air is provided downwardly to the upper of the shoe 100 to envelope the upper of the shoe 100 with the airflow, in contrast to a horizontal airflow which may only be directed at one side of a shoe, or an upwardly directed airflow which would be blocked by the sole of the shoe.

In addition, the downwardly-directed airflow is directed toward the bottom of the drawer and then will tend to spread out in all directions, providing well distributed air flow and reducing possible dead zones with little or no airflow in the drawer 30.

More particularly, the drawer 30 includes a bottom wall and a plurality of sidewalls that define an enclosed space having an open top side. The height of the sidewalls may be less than the width and depth dimensions of the drawer 30 so that the outlet of the airflow from the air supply unit 40 is relatively close to the bottom of the drawer so that the drawer bottom tends to redirect the downwardly-directed airflow outwardly in all directions.

The drawer bottom and the plurality of side walls may be configured to prevent air from passing therethrough so as to maximize the amount of air that is redirected upwardly. However, it is envisioned that the drawer bottom and/or the drawer sidewalls may include one or more apertures, such as a series of small ventilation holes, mesh or screening, to permit some of the airflow to pass therethrough.

The air supply unit 40 may be detachably provided on the partition 16, and more particularly, on the upper side of the partition 16. Here, a recess portion 17 may provided on the partition 16 to accommodate the air supply unit 40. More specifically, a central portion of the partition 16 includes a recessed portion (or recess) 17 extended downwardly in an upper side of the partition 16, and as such, a lower side of the partition includes an upwardly extended portion surrounding the central portion, the details of which will be described later in the discussion regarding airflow recirculation.

The drum 20 is positioned in the first space 12 above the partition 16, and therefore it is possible that water may fall on the partition 16 because of the rotation of the drum during a washing, rinsing or drying-spinning cycle. As a result, the recess portion 17 may also collect the water falling onto the partition 16. In addition to that, the recess portion 17 accommodates the air supply unit 40. As a result, although not shown in the drawings, a water drainage structure may be provided at a predetermined portion of the recess portion 17 to drain the collected water without contacting the air supply unit 40. Alternatively, a bottom surface of the recess portion 17 may slope enough so that the collected water does not to flow toward the air supply unit 40.

In reference to FIG. 2, the air supply unit 40 may be provided on the partition 16, and it can supply heated air to the second space 14. Specifically, the air supply unit 40 heats air from inside the first space 12 of the cabinet 10 and supplies the heated air to the second space 14. Here, the air inside the first space 12 will flow downwardly toward the second space 14 after being heated by the air supply unit 40. The downwardly-directed airflow is directed toward the bottom of the second space 14 and then will tend to spread out in all directions, providing well distributed air flow and reducing possible dead zones with little or no airflow in the second space 14.

Thus, the first space 12 forms a predetermined space where air is drawn into the air supply unit 40, that is, an air drawing space, and the second space 14 forms a predetermined space where air inside the air supply unit 40 is discharged, that is, an air discharging space. From a view of the air supply unit 40, the first space 12 is positioned on an air drawing path and the second space 14 is positioned on an air discharging path. As a result, an auxiliary inlet or outlet path for the air supply unit 40 does not have to be provided.

The air supply unit 40 is configured to supply the air into the second laundry treatment space 14 without passing through the drum 20. The drawer 30 has an enclosed space with an open top. More particularly, the drawer 30 includes a bottom wall and a plurality of sidewalls that define an enclosed space having an open top side. The drawer 30 substantially occupies an entirety of the second laundry treatment space 14. An accommodating space is formed in the drawer 30 and the accommodating space receives the laundry therein.

After the washing or drying process of the laundry in the first space 12, a user introduces the washed or dried laundry in the drawer 30 provided in the second space 14 to operate an auxiliary treating or refreshing process.

The drawer bottom and/or the drawer side walls may include a plurality of apertures, such as a plurality of small ventilation holes, mesh or screening, to permit air to pass there through.

Undesirable smells of laundry used one or two times may be removed by a deodorization filter (not shown) or a fragrance addition unit (not shown), which may be further provided in the drawer 30 according to this embodiment. The deodorization filter removes the odors of the laundry and the fragrance addition unit supplies fragrance to the laundry such that the user may feel pleasant when wearing the laundry. The filter or fragrance addition unit may be provided in the second space 14, specifically, in a front portion inside the drawer 30.

The air supply unit supplying air will be described in detail.

Figure 3:
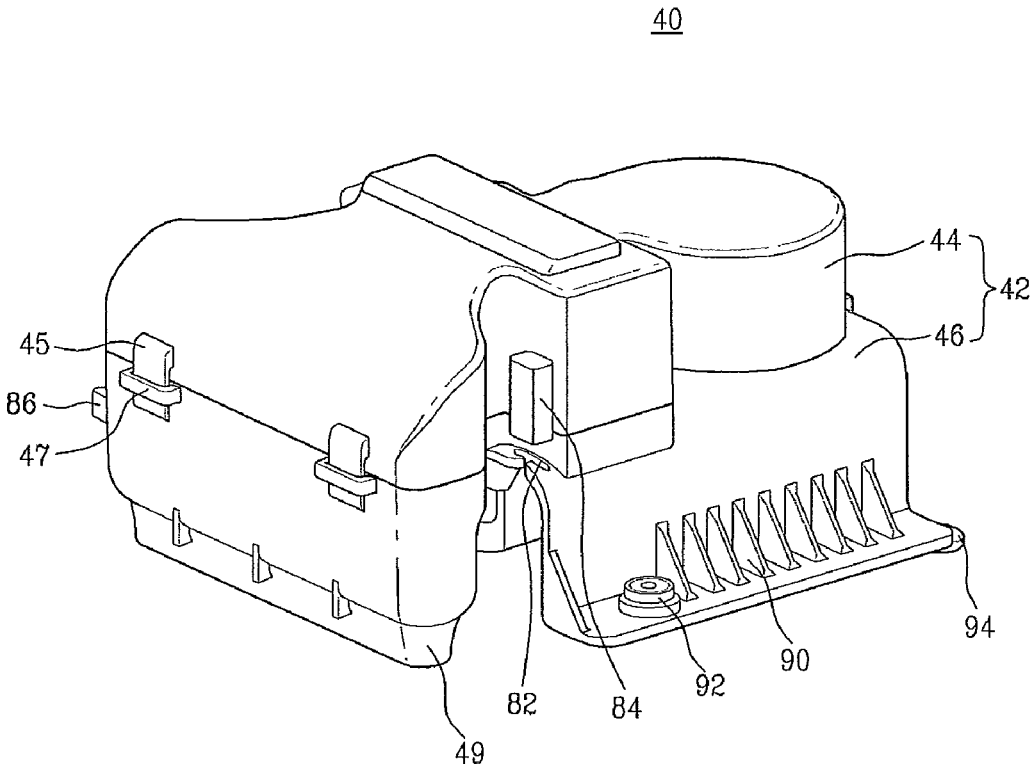
FIG. 3 is a perspective view illustrating a air supply unit shown in FIG. 1.
Figure 4:
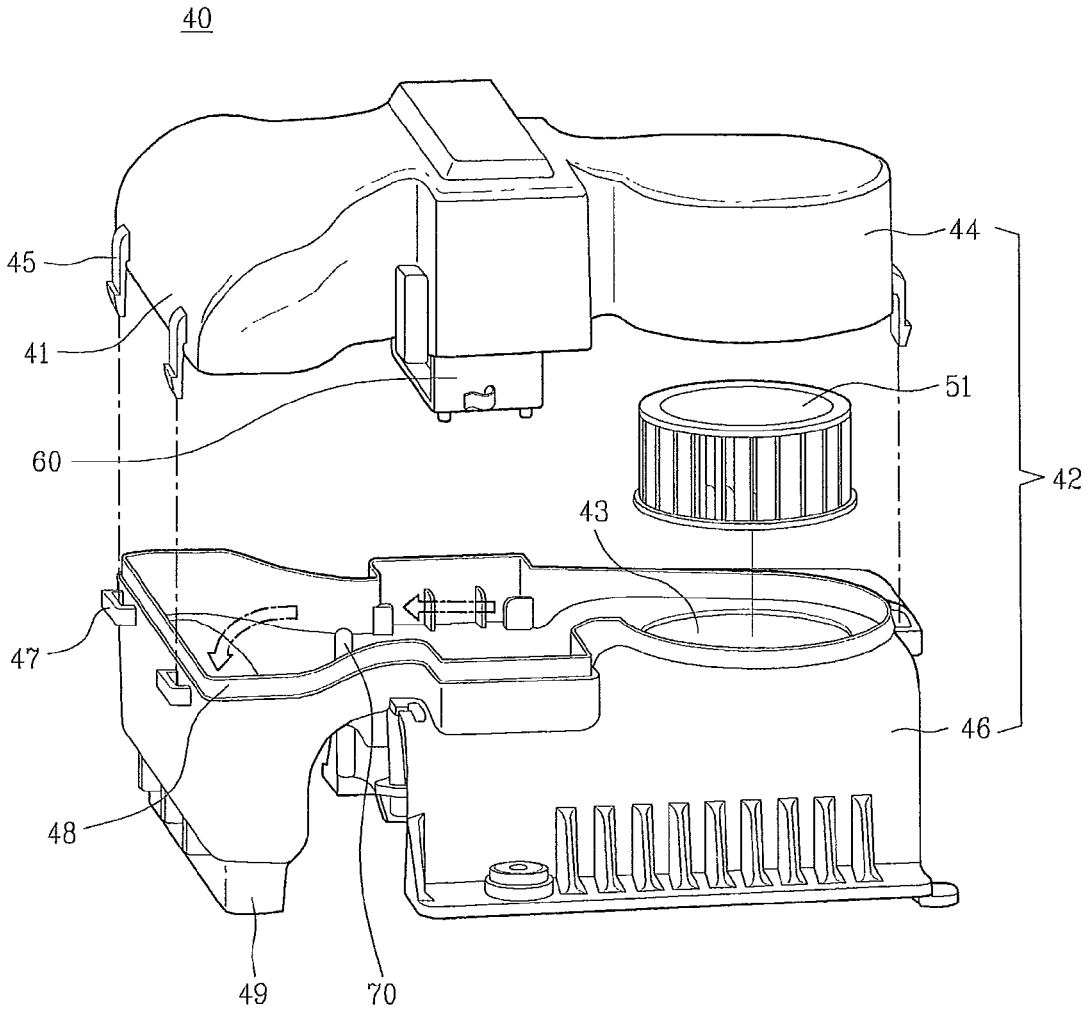
FIG. 4 is a perspective view illustrating an upper housing of FIG. 3 that is separated.

Referring to FIGS. 3 and 4, the air supply unit 40 according to this embodiment includes a housing 42. The housing 42 is detachably connected to a top surface of the partition (16) and it forms an air flow path.

The housing forms the air flow path through which the air flows along, and in the housing 42 may be provided the fan 51, the heating part 60 and the sub-control part which will be described later. Here, the housing 42 would be formed as one body that includes an upper housing 44 and a lower housing 46. The lower housing 46 is detachably coupled to the top surface of the partition 16. The upper housing 44 is detachably coupled to the lower housing 46. The detachable upper and lower housings 44 and 46 make it simple and convenient to repair inner components of the air supply unit 40 for maintenance.

Specifically, the lower housing 46 is detachably secured to the top surface of the partition 16 by a securing member such as a hook, bolt or the like. Alternatively, the lower housing 46 may be sliding along the top surface of the partition 16 to be detachably connected to the partition 16. For that, a projection 94 may be provided in the lower housing 46 and a slot 19 (see FIG. 5) where the projection 94 is insertedly secured may be provided in the partition 16 correspondingly.

Figure 5:
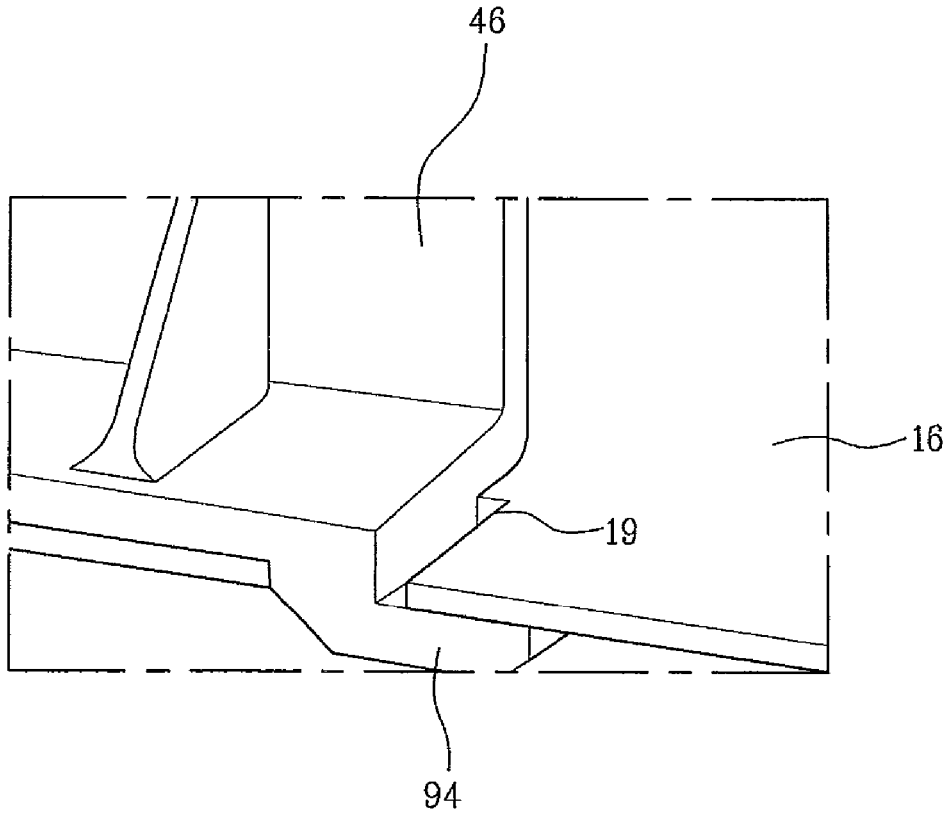
FIG. 5 is a perspective view illustrating a rear surface of the air supply unit shown in FIG. 3.

FIG. 5 is a perspective view illustrating a rear of the air supply unit. If the air supply unit 40 is sliding along the top surface of the partition 16, the projection 94 provided at an end portion of the lower housing 46 is inserted in the slot 19 provided in the top surface of the partition 16 such that the air supply unit 40 may be securely fixed.

Referring to FIG. 4 again, vibration could occur even in the air supply unit 40 fixed on the partition 16 by the projection 94 and the slot 19. This is because that vibration generated by the operation of the fan 51 may be transmitted to the air supply unit 40.

Because of that, the air supply unit 40 may include at least one boss 92 secured to the partition 16 by a securing member. A worker makes the securing member pass through the boss 92 and secured to the partition 16 such that the air supply unit 40 is installed securely.

However, in this case, an end of the securing member may project into the second laundry treatment space 14, passing the partition 16. The end of the securing member projecting into the second laundry treatment space 14 could hurt a user's finger when sliding the drawer 30 outward to take out the laundry or it could damage to fabric of the laundry. To solve this problem, a configuration of the boss according to this embodiment will be described as follows.

Figure 6:
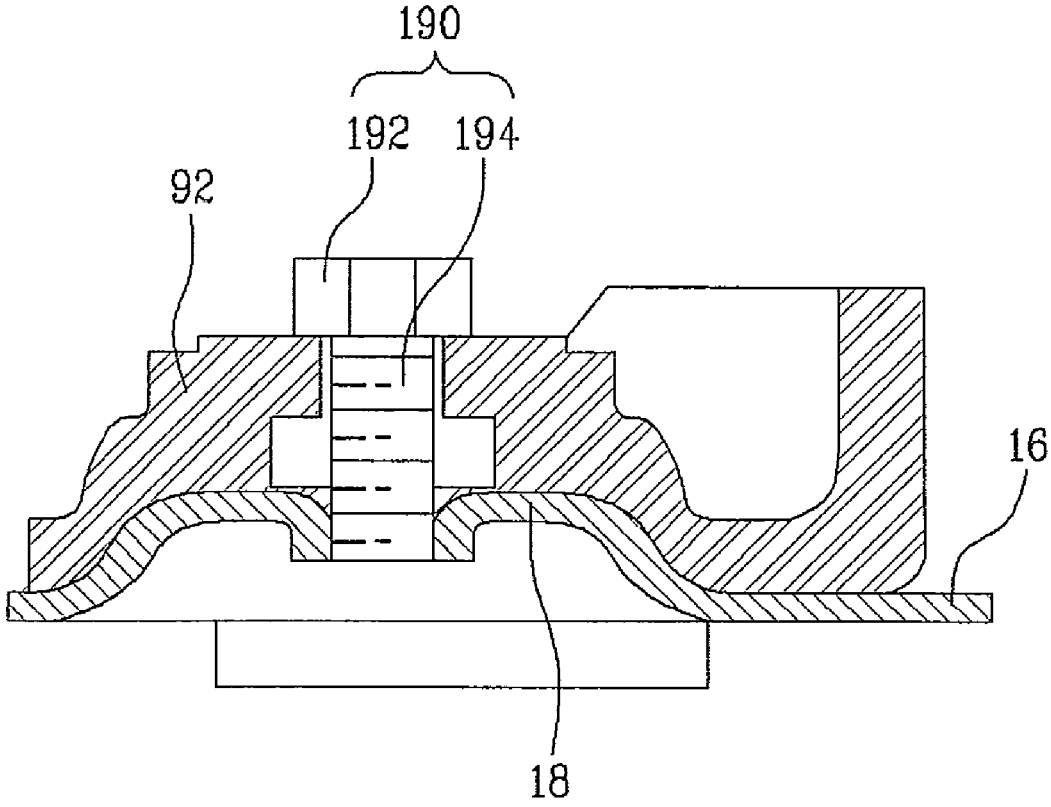
FIG. 6 is a side sectional view illustrating a boss of the air supply unit shown in FIG. 3.

Referring to FIG. 6, the boss 92 may be projected upward from the air supply unit 40. In other words, the boss 92 may be projected upward from the second laundry treatment space 14.

A securing portion 18 corresponding to the boss 92 may be provided in the top surface of the partition 16. The securing portion 18 may be projected. In case the boss 92 of the air supply unit 40 is projected, a recess portion may be formed in a bottom surface of the boss 92. As a result, when the air supply unit 40 is installed on the partition 16, the securing portion 18 is received in the recess portion of the boss 92. Therefore, the air supply unit 40 may be positioned conveniently and appropriately.

In this case, the overall thickness of both the boss 92 and the securing portion 18 may be corresponding to the length of a body portion 194 of a securing member 190. Therefore, an end of the securing member 190 may not pass through the bottom surface of the partition 16 into the second laundry treatment space.

Referring to FIGS. 3 and 4, a plurality of ribs 90 may be provided in the lower housing 46 to reinforce the lower housing 46. The ribs 90 may be arranged along both sides of the housing.

The upper housing 44 is detachably coupled to the lower housing 46. The upper housing 44 and the lower housing 46 may be coupled by a coupling member such as a bolt or hook. According to this embodiment, a plurality of hooks 45 may be provided in the upper housing 44 and a plurality of engaging members 47 corresponding to the hooks 45 may be provided in the lower housing 46. The upper housing 44 may be coupled to the lower housing 46 efficiently and it may be connected, forming a path through which air flows along an arrow shown in FIG. 4.

The air supply unit 40 may be positioned on the top surface of the partition 16, that is, below the drum 20 (see FIG. 1) as mentioned above. When the drum 20 is operated, water may fall on the air supply unit 40. If the water enters into the housing 42, the inner components of the housing 42 such as the heating part 60 could malfunction or be damaged. Especially, if the upper housing 44 and the lower housing 46 of the housing 42 are formed of separate members, respectively, the water may pass through the connection portion between them. Because of that, the air supply unit 40 according to this embodiment may include a water preventing part for preventing the water from entering the housing. For example, the water preventing part may extend outwardly from the housing 42.

Figure 7:
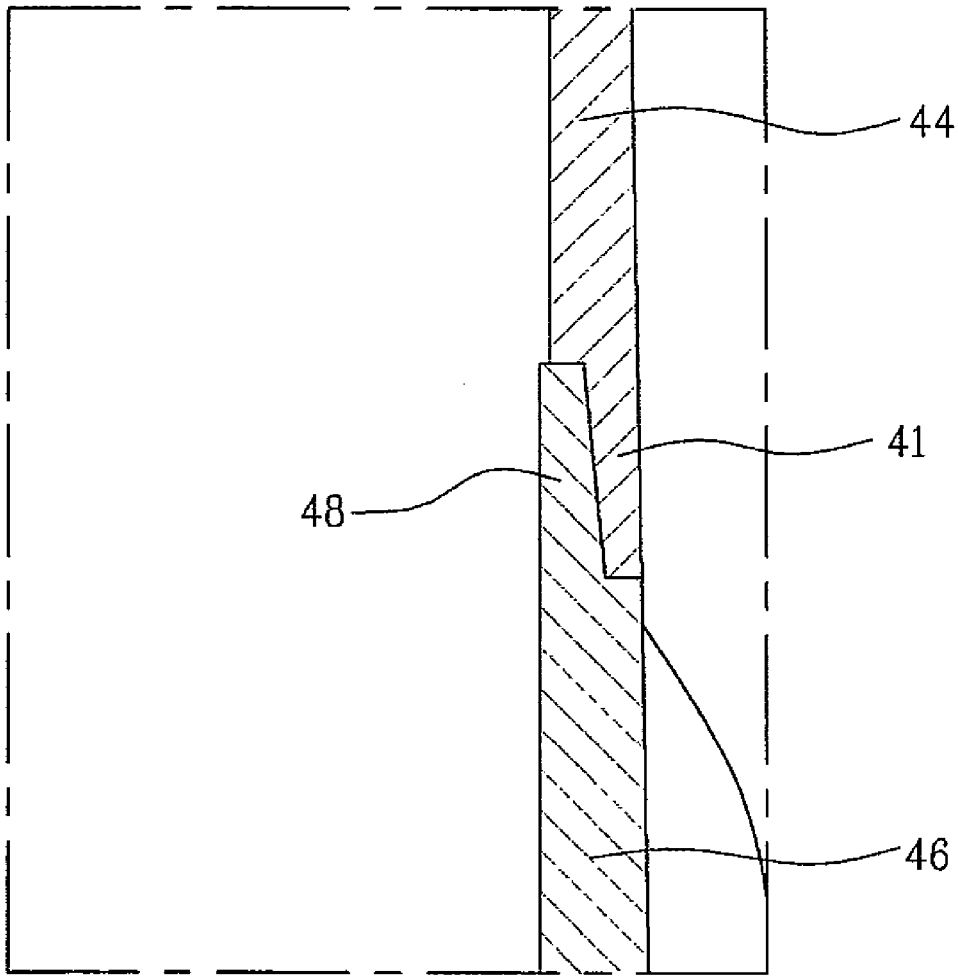
FIG. 7 is a side sectional view illustrating a connection between an upper housing and a lower housing.

Referring to FIG. 7, the water preventing part includes a first extending portion 41 which extends downward from an edge of the upper housing 44 and a second extending portion 48 which extends upward from an edge of the lower housing 46.

The first extending portion 41 is formed along a rim of the upper housing 44, encircling a predetermined portion of a rim of the lower housing 46, and thereby covering the rim of the lower housing 46. The second extending portion 48 is coupled to the first extending portion 41, specifically, to an inside of the first extending portion 41. As a result, the water on the top of the housing 42 flows along a surface of the first extending portion 41 sequentially, not passing into the housing 42 along the connection portion, and it falls toward the partition 16.

Referring to FIGS. 3 and 4, as mentioned above, the path of the airflow is in the housing 42. The path is formed between the lower housing 46 and the upper housing 44, and air flows along the path shown as the arrow in FIG. 4. The fan 51 for blowing air along the path and the heating part 60 for heating the air may be provided inside the housing. Although it is shown in FIG. 4 that the fan 51 and the heating part 60 are arranged sequentially along the flowing direction of the air so that the fan 51 blows air to the heating part 60, the present invention is not limited thereto and it is also possible to arrange the heating part 60 and the fan sequentially so that the fan 51 draws air from the heating part 60. The fan 51 is a centrifugal fan in the embodiment shown. However, it is envisioned that alternative fan designs such as an axial fan or scirocco fan may be used.

Once the fan 50 is put into operation, air outside the housing 42 is drawn into the housing 42 via an air inlet 43. The air inlet 43 is provided at a lower side of the housing 42, in communication with the first space 12. Because the air inlet 43 is formed at the lower side of the housing 42, water may be prevented from being come into the housing 42 through the air inlet 43. Here, it is envisioned that the rpm of the fan 50 is adjustable. Since the rotation speed of the fan 50 is adjustable, the amount of the air supplied by the fan 51 may be adjustable. The air drawn into the housing 42 is heated by the heating part 60 and the heated air is discharged through an outlet 49. In this case, the outlet 49 is connected with a aperture 15 (see FIG. 2) forming a heated air inlet in the partition 16, and is directed toward downwardly. It is envisioned that the outlet 49 is approximately perpendicular to the aperture 15, and is directly connected with the aperture 15. As a result, the heated air may flow downwardly toward the second laundry treatment space 14, that is, the drawer 30.

Figure 8:
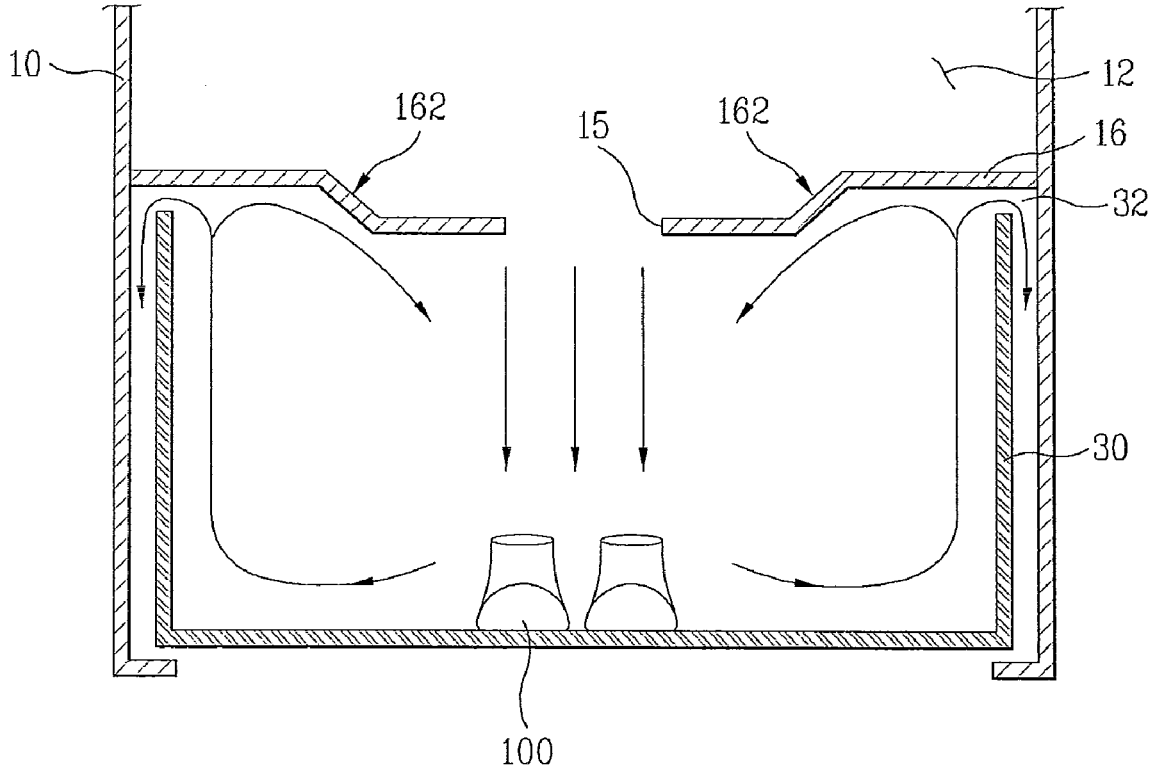
FIG. 8 is a diagram illustrating air flow inside the drawer.

FIG. 8 is a diagram schematically illustrating the flow of the air supplied to the drawer 30 by the air supply unit 40.

Referring to FIG. 8, the air discharged via the outlet 49 passes the heated air inlet 15, and the air flows toward a side upper portion inside the drawer 30 via a center lower portion. Because of that, a dead zone inside the drawer 30, which air fails to reach, may be reduced as much as possible.

Also, as shown in FIG. 2, the lower side of the partition 16 may have an upwardly extended portion surrounding the recessed portion in the upper side of the partition 16. This upwardly extended portion may include inclined portions 162 configured to redirect airflow inwardly toward the central portion of the partition 16, and downwardly away from the partition 16, and back toward the drawer 30. This arrangement permits some of the air to be recirculated, which may promote heating, drying or other treatment of laundry in the drawer 30.

As shown in FIG. 6, a gap 32 is provided between the partition 16 and the drawer 30 to permit air to pass therethrough and exit the drawer 30 for subsequent exiting of the second laundry treatment space 14. Also, if the laundry is put on a bottom surface of the drawer 30, air can contact with the laundry as much as possible.

The bottom of the drawer 30 tends to redirect the downwardly-directed airflow outwardly in all directions toward the drawer sidewalls. Thereafter, the drawer sidewalls tend to redirect the airflow upwardly toward the partition 16. Finally, the partition 16 tends to redirect the airflow inwardly toward the central portion of the partition 16, where the airflow joins with the downwardly-directed airflow, and is recirculated.

Referring to FIGS. 3 and 4 again, the air supply unit 40 according to this embodiment may further include a first temperature sensor 70 which senses the temperature of the heated air. The heating part 60 may be controlled according to the temperature values monitored by the first sensor 70 to supply the heated air.

This temperature sensor 70 may be provided in a predetermined portion inside the path and it is envisioned that the temperature sensor 70 is provided at an end of the path, that is, adjacent to the outlet 49. The operation of the heating part 60 may be controlled according to the measured temperature according to the temperature sensor 70 such that the temperature of the air supplied to the second laundry treatment space 14 may be controlled.

The temperature sensor 70 may be installed by a method of forced insertion or using adhesive. It is envisioned that the temperature sensor 70 is fixed securely enough to endure the pressure of the air blown by the fan 51. In reference to corresponding drawings, the temperature sensor will described.

Figure 9:
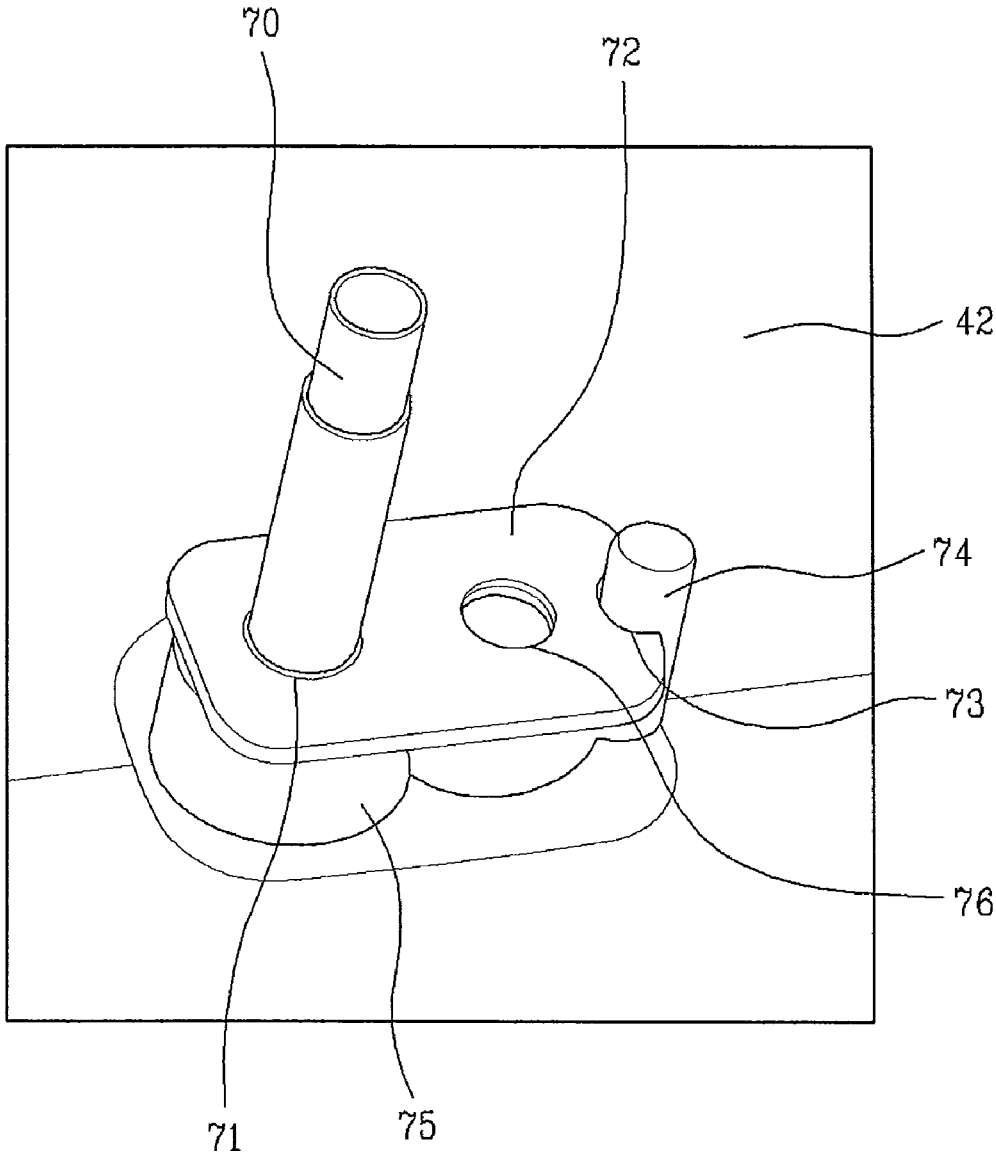
FIG. 9 is a perspective view illustrating a state of a temperature sensor shown in FIG. 3 being installed.

FIG. 9 is a perspective view illustrating a fixing unit for fixing the temperature sensor 70, seen upward under the housing 42.

Referring to FIG. 9, the fixing unit includes a fixing plate 72 for securing the temperature sensor 70, and a fixing member 74 extending from the housing 42 to fix a position of the fixing plate 72.

The temperature sensor 70 may pass a through hole 71 provided in the fixing plate 72. The temperature sensor 70 may be also fixed by inserting through the through hole 71 forcibly or adhesives. Here, a securing hole 76 may be provided in the fixing plate 72 for the temperature sensor 70 to be secured to the housing 42. A securing member (not shown) passes the securing hole 76 and the housing such that the fixing plate 72 is secured to the housing 42. Thus, the temperature sensor 70 is fixed to the housing 42 primarily and to the fixing plate secondarily. The housing 42 may further include a fixing portion 75 the temperature sensor 70 passes. The temperature sensor 70 passes through the fixing portion 75 and it is fixed to the fixing plate 72 securely.

In case the fixing plate 72 is connected to the housing 42, a fixing member 74 may be further provided. The fixing member 74 is connected with the housing 42, and fixes a position of the fixing plate 72. The fixing member 74 may extend from the housing 42. A fixing recess 73 corresponding to the fixing member 74 may be provided in the fixing plate 72. The fixing recess 73 is provided at a predetermined portion of the fixing plate 72. The fixing member 74 is inserted in the fixing recess 73. Once an end of the temperature sensor 70 is inserted in the through hole 71 and the fixing member 74 is received in the fixing recess 73, the fixing plate 72 is fixed and then the worker can pass the securing member through the securing hole 76.

In reference to FIG. 4 again, the laundry machine controls the operation of the heating part 60 according to the temperature of the air measured by the temperature sensor 70. Therefore, the temperature of the heated air supplied to the second laundry treatment space 14 may be controlled. To control the heating part 60 by the temperature of the heated air measured by the temperature sensor 70, a single control part may be provided or at least two control parts may be provided.

If at least two control parts are provided, for example, a main-control part and a sub-control part, a main-control part controls an overall operation of the drum 20 and the air supply unit 40. The temperatures measured by the temperature sensor 70 may be transmitted to the main-control part.

The main-control part may control the heating part 60 and the fan 51 of the air supply unit 40 according to a corresponding signal transmitted by the temperature sensor. In this case, a command signal generated by the main-control part is transmitted to the sub-control part provided in the air supply unit 40. Hence, the sub-control part controls the heating part 60 and the fan 51 according to the command signal of the main-control part. If receiving the command signal from the main-control part, the sub-control part may perform only the on and off control of the heating part 60 or the fan 51 in order to simplify the configuration.

As mentioned above, the air supply unit 40 may include components such as the fan 51 and the heating part 60 and these components are driven by electricity. Because of that, wires for supplying electricity to these components may be positioned along an outside or inside of the air supply unit 40. If the worker performs repair and maintenance of the air supply unit of which the wires are arranged, scattered separately, these wires may interfere with the work performance. In addition, the scattered wires could accompany danger of short circuit because of water falling from the drum 20 provided beyond the air supply unit 40. According to this embodiment, the air supply unit 40 may include a fixing member fixing the wires in the housing 42.

FIG. 3 shows a wire fixing member configured of a hook 86 fixing wires arranged along an outside of the air supply unit 40 and at least one wire fixing member 82 and 84 fixing wires connecting an inside of the air supply unit 40 with the outside. This configuration will be described in detail in reference to a corresponding drawing.

Figure 10:
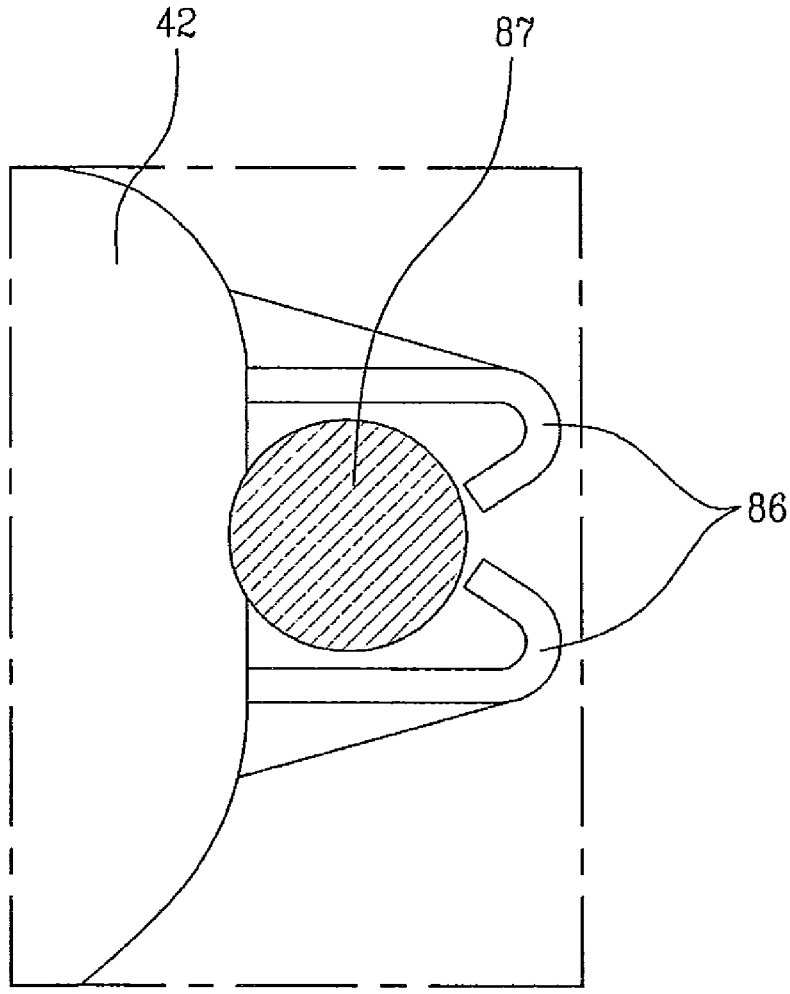
FIG. 10 is a plane view illustrating an embodiment of a fixing member shown in FIG. 3.

In reference to FIG. 10, a fixing hook 86 is provided in a predetermined portion of the housing 42, integral with the housing 42. As a result, wires 87 arranged along an outside of the housing 42 of the air supply unit 40 may be inserted in the fixing hook 86, without scattered.

Figure 11:
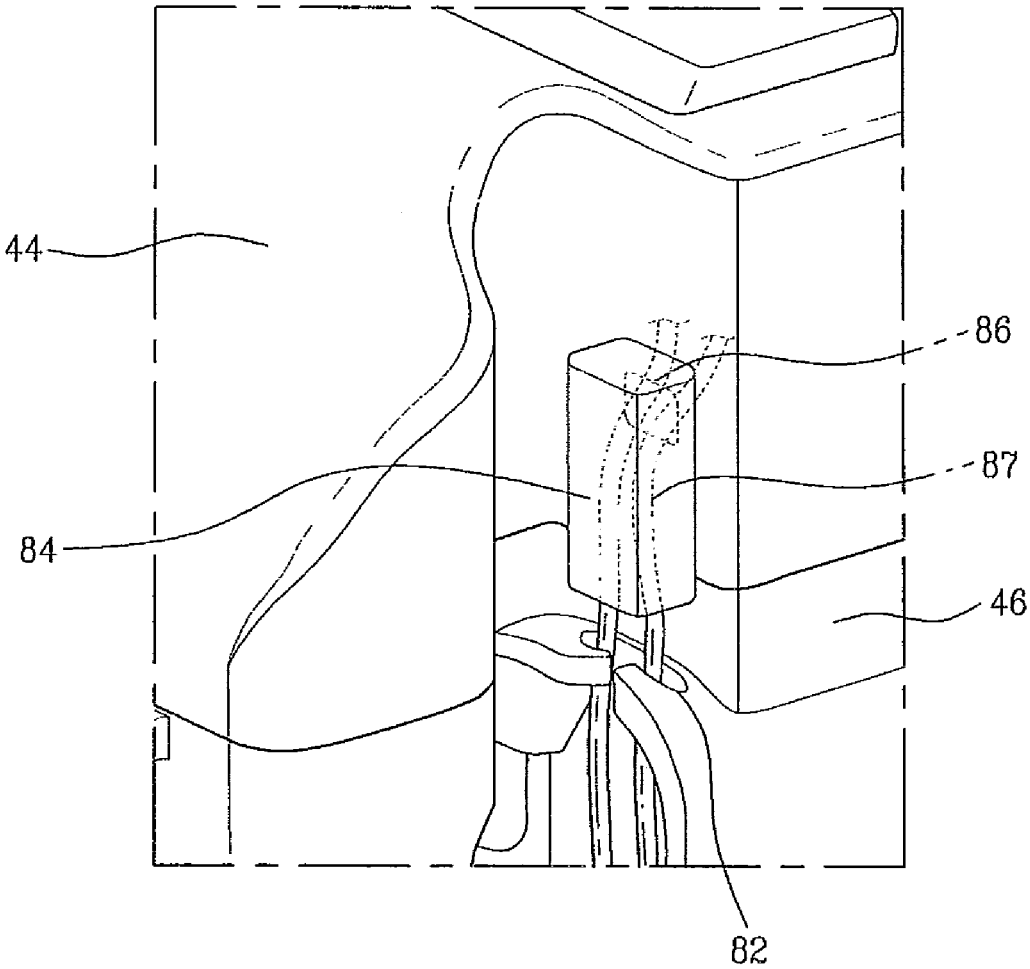
FIG. 11 is a perspective view illustrating another embodiment of the fixing member shown in FIG. 3.

FIG. 11 is a enlarged perspective view illustrating fixing members 82 and 84 fixing wires connecting the inside with the outside of the air supply unit 40. Since the heating part 60 is positioned in the housing 42 of the air supply unit 40, wires applying electricity to the heating part 60 may be extending outside from the inside of the housing 42 such that the fixing member shown in FIG. 10 can fix the wires.

In reference to FIG. 11, the fixing member includes a fixing groove 82 provided in the housing 42 and a through hole 86 communicating the inside of the housing 42 with the outside to pass the wire 87 there through.

The wires 87 are fixedly inserted in the fixing groove 82 from the outside of the housing 42. Hence, the wires 87 fixed in the fixing groove 82 passes the through hole 86 provided in the housing 42 and they are arranged inside the housing 42. The wires 87 extending into the housing 42 are connected with the heating part 60 and they apply electricity.

In case the wires are arranged from the outside to the inside of the housing 42, water falling from the drum 20 would contact with the wires 87 or enters into the housing via the through hole 86. Because of that, an inflow preventing part 84 may be further provided in the housing 42 to prevent water from inflowing the housing 42 via the through hole 86. The inflow preventing part 84 may be formed adjacent to the through hole 86. It is envisioned that the inflow preventing part 84 covers the through hole 86 such that the falling water may not flow toward the through hole 86. This inflow preventing part 84 may be an embodiment of the water preventing part described above.

When the user opens the drawer 30 during the air supplying via the outlet 49 of the air supply unit 40, the user's hand happens to come into the outlet 49 only to get burned. Because of that, a structure preventing the user's hand or foreign matters from coming into the outlet 49 of the air supply unit 40 may be provided and this will be described in a corresponding drawing as follows.

Figure 12:
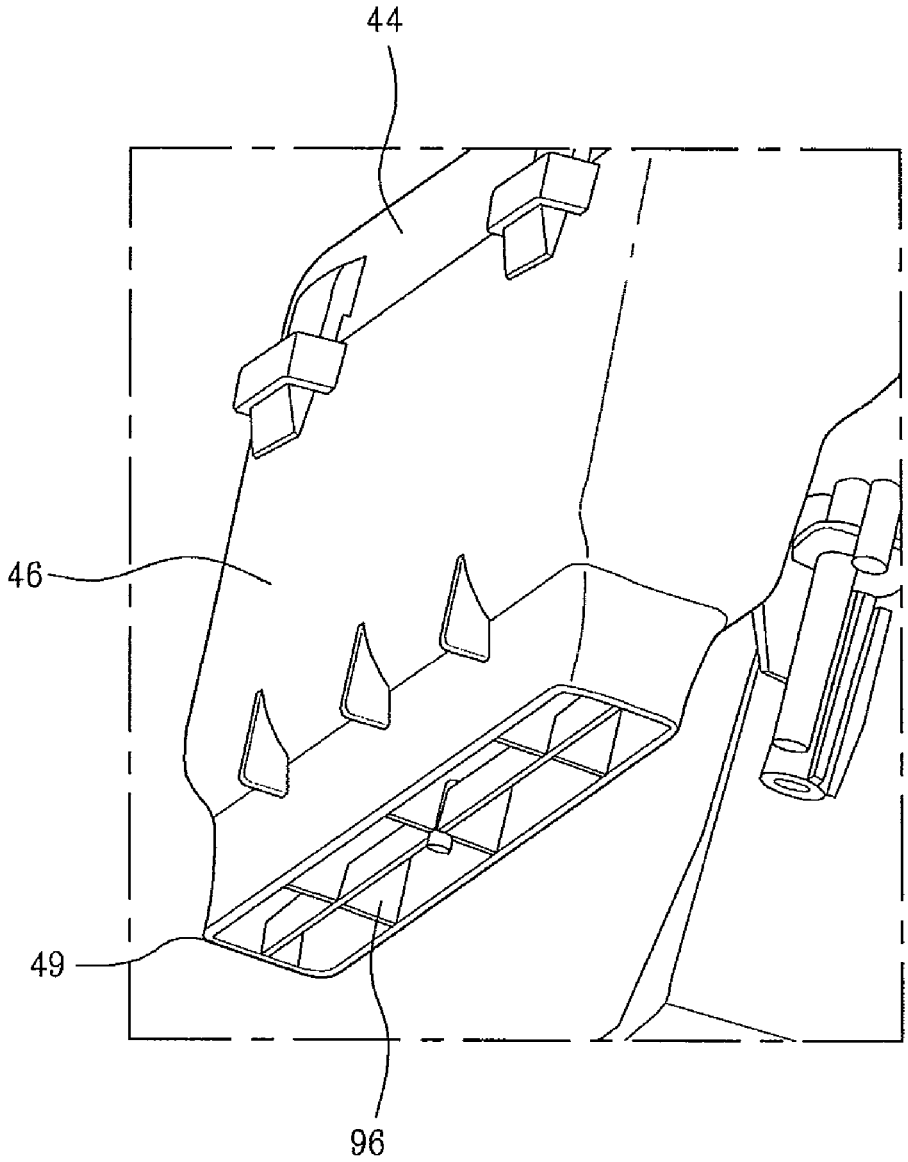
FIG. 12 is a perspective view illustrating a air outlet shown in FIG. 3.

In reference to FIG. 12, the air supply unit 40 may include a guide rib 96 preventing the user's hand or foreign matters from coming into the air supply unit 40 via the outlet 49.

The guide rib 96 is provided at the outlet 49 and it prevents the user's hand or foreign matters from coming into the outlet 49. For example, the guide rib 96 may be provided in a grid shape as shown in FIG. 11 and the shape of the guide rib 96 may be variable, not limiting to the grid shape. Here, the guide rib 96 is employed to reinforce the rigid and strength of the housing 42 as well as to prevent foreign matters from being drawn into the air supply unit 40 via the outlet 49.

The air supply unit 40 may include electric parts, such as a motor (150, see FIG. 14) driving the fan 51, a sub-control part (not shown). Such the electric parts may be provided in the housing. However, the electric parts would be provided outside the housing, because the housing 42 may have relatively small inner space. According to this embodiment, the electric parts are provided at a lower side of the housing 42. Because of that, it is envisioned that the air supply unit 40 includes a water access preventing part preventing the electric parts from being wetted. This structure will be described as follows.

Figure 13:
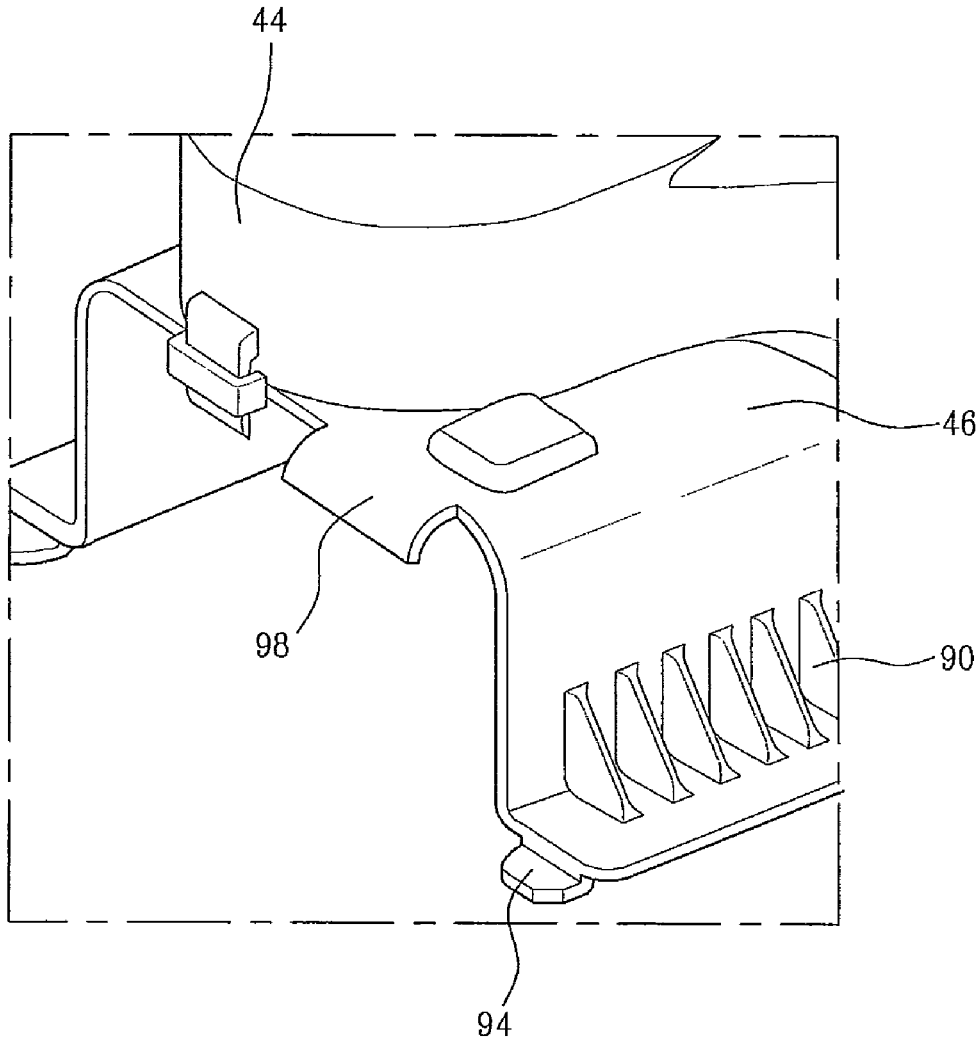
FIG. 13 is a perspective view illustrating a rear surface of the air supply unit, seen above.

FIG. 13 is a perspective view illustrating a rear surface of the air supply unit 40.

Referring to FIG. 13, the water access preventing part includes an extending portion 98 provided in the housing 42. The extending portion 98 prevents the electric parts such as the motor 150 of the fan 51 from being wetted.

Specifically, the extending portion 98 extends outward from an edge of the housing 42, with a downward curvature. Even if water falls from the drum 20, water falls along the extending portion 98 from the surface of the housing 42 into the partition 16. Therefore, the falling water may not come to the motor 150 and the sub-control part provided at the lower side of the housing 42.

Referring to FIG. 4 again, the lower housing 46 includes a supporting portion 46' extending downward. The bosses 92 and the ribs 90 mentioned above may be provided in an end of the supporting portion 46'. The supporting portion 46' according to this embodiment is configured to cover a lower side of the housing 42. The water falling down may not come toward the motor 150 and the sub-control part provided at the lower side of housing 42. As a result, the supporting portion 46' covering the lower side of the housing 42 may be an embodiment of the water access preventing part.

Figure 14:
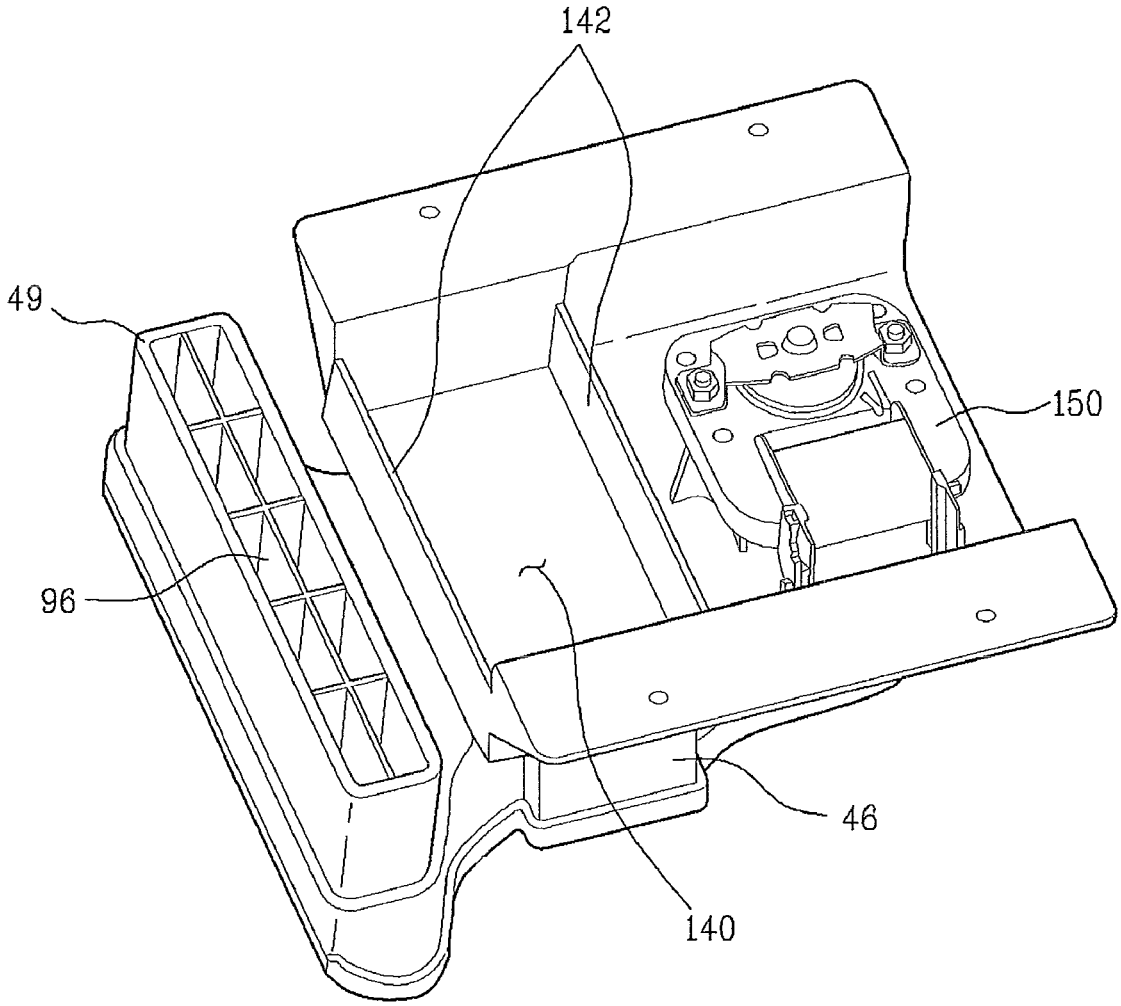
FIG. 14 is a perspective view illustrating the air supply unit, seen below.
Figure 15:
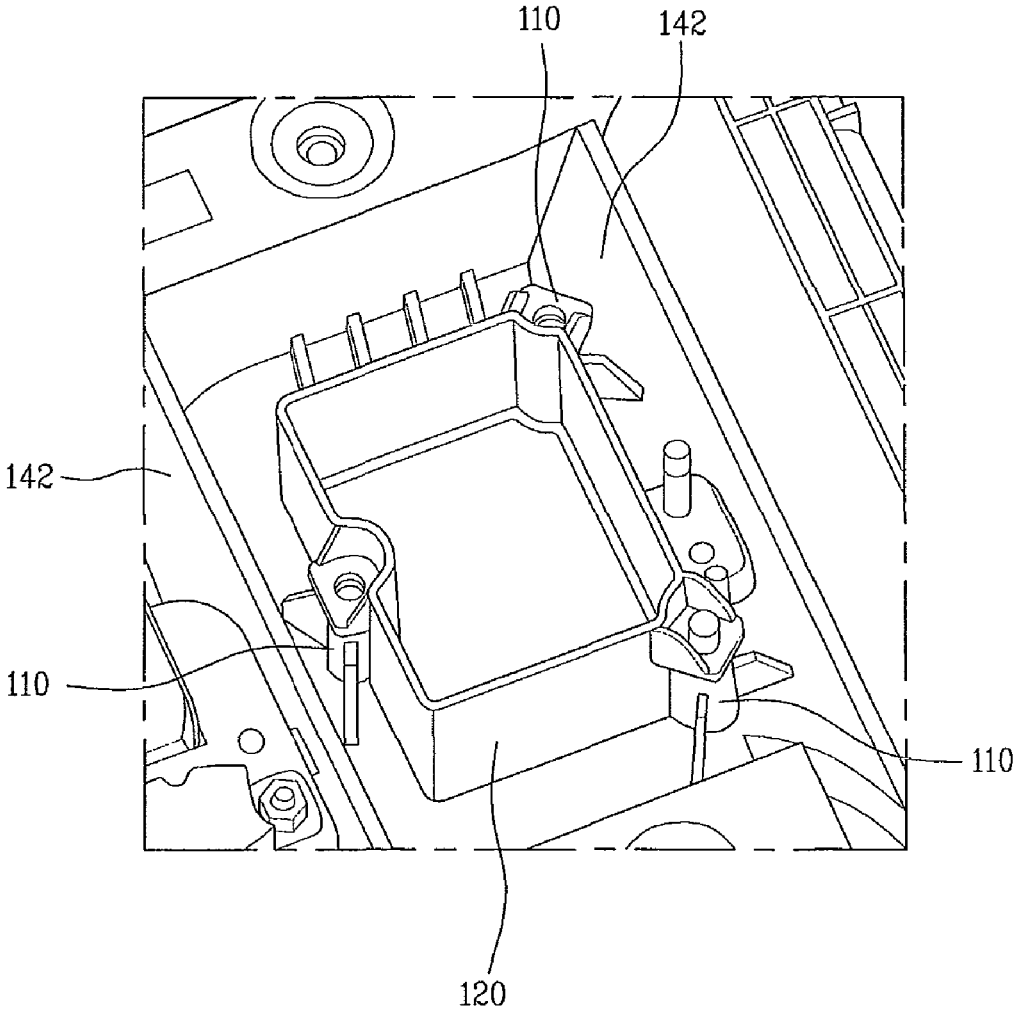
FIG. 15 is a perspective view illustrating a guide part where a control part is seated.

FIGS. 14 and 15 are perspective view illustrating the housing 42 of the air supply unit 40.

Referring to FIGS. 14 and 15, a seating portion 140 may be provided in a bottom surface of the housing 46. The sub-control part may be seated in the seating portion 140. Here, the seating portion 140 may be partitioned by a plate 142 provided in the bottom surface of the lower housing 46. The plate 142 may be formed of a separate member or integrally with the lower housing 46.

Hence, the sub-control part may be seated in the seating portion 140. It is envisioned that at least one securing boss 110 may be provided and the securing boss 110 is secured to the sub-control part to determine a portion of the sub-control part precisely. Here, the securing boss 110 is not shown in FIG. 14.

In case the sub-control part includes a cover 120 and an operation part (not shown) received in the cover 120, the worker secures the cover 120 to the securing boss 110 by a securing member and the operation part is accommodated in the cover 120. Here, only the cover of the sub-control part is shown in FIG. 14 for convenience sake. As a result, the worker can assemble the sub-control part securely and efficiently and the time required for the assembly work may be reduced.

Figure 16:
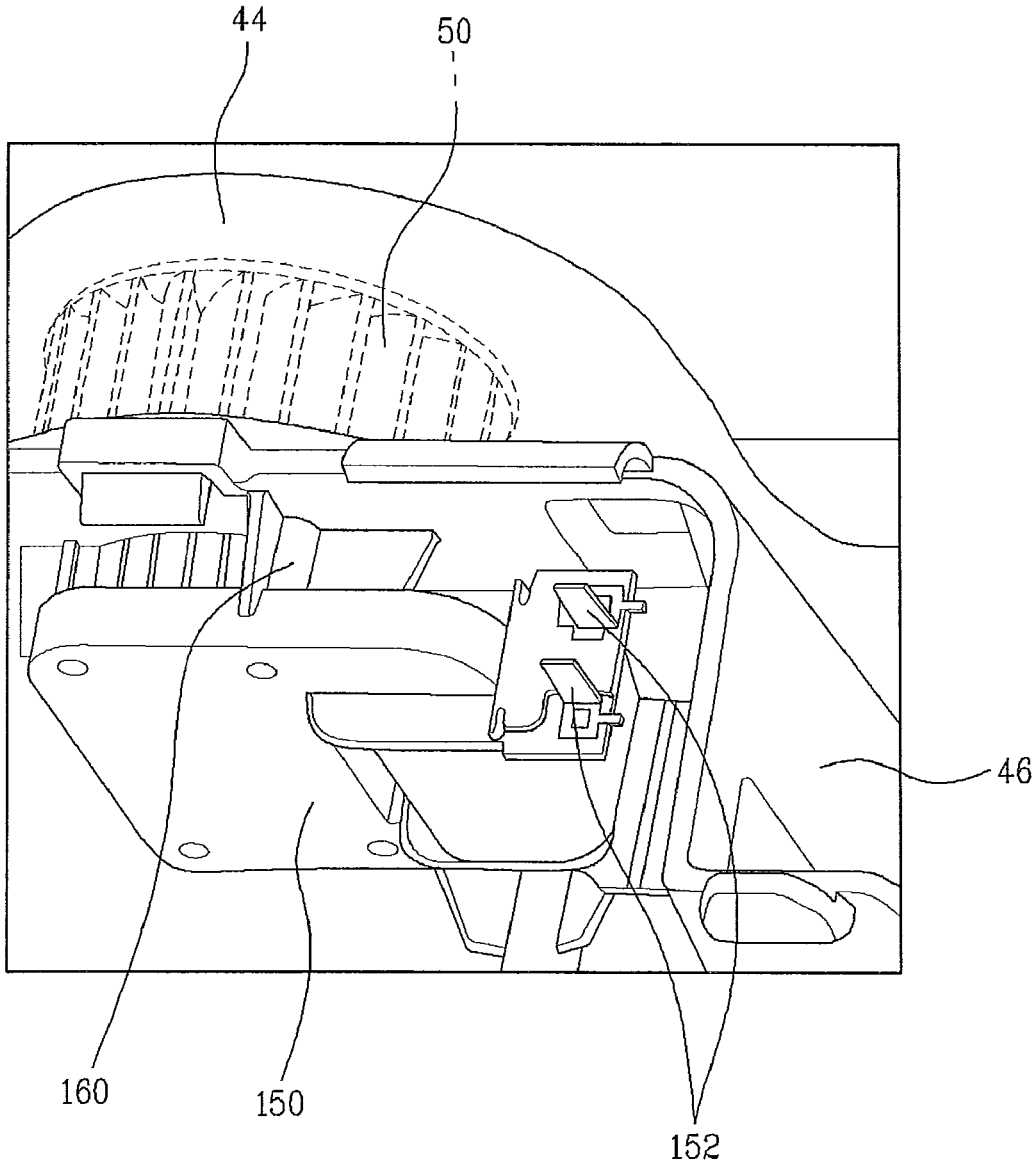
FIG. 16 is a perspective view illustrating the air supply unit, sees below.

FIG. 16 is a perspective view illustrating the housing 42 of the air supply unit 40. The fan 51 provided in the housing 42 is rotated by the motor 150 and the motor 150 may be mounted on the bottom surface of the lower housing 46. Water would fall from the drum 20 and it is envisioned that electric devices such as the motor 150 are provided in the lower housing 46.

Also, a terminal part 152 may be provided at the motor 150, and wires for supplying electricity are connected with the terminal part 152. As the terminal part 152 supplies electricity to the motor 150, the temperature of the terminal part 152 may increase during the operation of the motor 150. If the terminal part 152 directly contacts with the housing 42 of the air supply unit 40 or it is positioned adjacent to the housing 42 closely, the heat of the terminal part 152 would deform the housing.

Thus, it is envisioned that the motor 150 is spaced apart a predetermined distance from the housing 42. Specifically, the motor 150 may be connected with a spacer 160 provided in the lower housing 46. That is, an end of the space 160 is connected with the lower housing 46 and the other end of the space 160 is connected with the motor 150. It can be said that the space 160 not only supports the motor 150 but makes the terminal part 152 of the motor 150 being spaced apart from the lower housing 46.

An operation of the laundry machine having the above configuration will be described in reference to the drawings as follows.

First of all, the user loads the laundry into the drawer 30 of the cabinet 10 and selects a wished course, for example, a hot air course or an air ventilation course for ventilating only air. In case of the hot air course, air is heated by the air supply unit 40 and hot air is supplied to the second space 14, that is, the drawer 30. Here, the temperature sensor 70 monitors the temperature of the air and the air supply unit 40 is controlled according to the temperature measured by the temperature sensor 70.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine comprising:

a first laundry treatment space configured to receive laundry therein;

a second laundry treatment space configured to receive laundry therein;

an air supply unit configured to supply air to the second laundry treatment space, the air supply unit comprising a fan, a heater and a housing, wherein the fan, the heater, an air inlet and an air outlet are provided at the housing;

a cabinet; and a partition for partitioning an inner space of the cabinet into the first laundry treatment space and the second laundry treatment space, wherein the air supply unit is detachably provided on an upper side of the partition and comprises a water penetration preventing part for preventing water from entering the housing, wherein the water penetration preventing part comprises a first extending portion extending downwardly from an upper housing and overlapping a portion of a lower housing.

2. The laundry machine of claim 1, wherein the water preventing part extends outwardly from the housing.

3. The laundry machine of claim 1, wherein the lower housing is provided in the cabinet and the upper housing is coupled to the lower housing.

4. The laundry machine of claim 3, wherein the first extending portion covers a predetermined portion of the lower housing.

5. The laundry machine of claim 4, wherein the water preventing part further comprises a second extending portion extending upward from the lower housing to be coupled to the first extending portion.

6. The laundry machine of claim 1, wherein the air supply unit comprises at least one boss coupled to the partition by a securing member, and a securing portion is provided in the partition and the securing portion is projected corresponding to the boss, and wherein the boss and the securing portion corresponds to the length of a body of the securing member.

7. The laundry machine of, claim 1, wherein the first extending portion overlaps a second extending portion of the lower housing.

* * * * *